United States Patent [19]

Ofsowitz et al.

[11] 4,453,325

[45] Jun. 12, 1984

[54] ADVERTISING DISPLAY MEANS FOR PARKING METER AND THE LIKE

[76] Inventors: Warwick N. Ofsowitz, 3115 Old Post Dr., Pikesville, Md. 21208; Robert S. Ginsburg, 6803 Westbrook Rd., Baltimore, Md. 21215

[21] Appl. No.: 391,722

[22] Filed: Jun. 24, 1982

[51] Int. Cl.[3] ..... G09F 3/00

[52] U.S. Cl. ..... 40/333; 40/607; 40/10 R

[58] Field of Search ..... 40/584, 333, 210, 10 R; 29/400 R, 400 M

[56] References Cited

U.S. PATENT DOCUMENTS

| | | | |
|---|---|---|---|
| 77,545 | 5/1868 | Sonnedecker | 40/145 X |
| D. 152,294 | 1/1949 | Siegel et al. | 40/333 X |
| 915,287 | 3/1902 | Hasse | 40/145 X |
| 1,864,641 | 6/1932 | Davis | 40/210 |
| 1,973,275 | 11/1936 | Babson | 40/333 X |
| 2,063,121 | 1/1937 | Babson | 40/333 X |
| 2,217,776 | 10/1940 | Sweetland | 40/333 |
| 2,288,151 | 6/1942 | Alexander | 40/607 |
| 2,421,917 | 6/1947 | Williams | 40/333 |
| 2,468,421 | 7/1947 | Williams | 40/333 X |
| 2,507,875 | 9/1947 | Williams | 40/607 X |
| 2,539,546 | 1/1951 | McGuire | 40/607 X |
| 2,554,923 | 5/1951 | Reitz | 40/333 |
| 2,572,174 | 10/1951 | McKenzie | 40/33 |
| 2,616,196 | 12/1952 | Sandahi et al. | 40/333 X |
| 2,625,761 | 1/1953 | Thompson et al. | 40/333 |
| 2,639,527 | 5/1953 | Ezzy et al. | 40/333 |
| 2,828,566 | 4/1958 | Cytron et al. | 40/333 |
| 2,869,261 | 1/1959 | Audette | 40/210 |
| 2,985,978 | 5/1961 | Breen et al. | 40/333 |
| 3,479,760 | 11/1969 | Snyder | 40/607 |
| 3,486,262 | 12/1969 | Gregoire | 40/607 X |
| 3,538,882 | 11/1970 | Price | 40/607 X |
| 3,803,738 | 4/1974 | Weiss | 40/611 |
| 3,928,928 | 12/1975 | Attwood | 40/607 |
| 4,010,698 | 3/1977 | Taub | 108/111 |
| 4,164,084 | 8/1979 | Crockett | 40/18 |
| 4,176,486 | 12/1979 | Williams | 40/607 |
| 4,276,709 | 1/1981 | Selleslags | 40/2 R |

FOREIGN PATENT DOCUMENTS

| | | | |
|---|---|---|---|
| 1032836 | 6/1966 | United Kingdom | 40/333 |

*Primary Examiner*—Gene Mancene
*Assistant Examiner*—Wenceslao J. Contreras
*Attorney, Agent, or Firm*—Bloom, Leonard

[57] ABSTRACT

An advertising display means is provided for a parking meter of the type having a removable housing component accessible internally of the meter. The display means comprises a unitary member having a first portion which is substantially identical to the removable housing component and is substituted therefor out in the field or during routine maintenance in the workshop. The unitary member further has a second planar portion, integral with the first portion, and extending vertically above the meter. A pressure-sensitive adhesive decal or label, bearing an advertising message, is secured to the planar portion.

15 Claims, 12 Drawing Figures

ADVERTISING DISPLAY MEANS FOR PARKING METER AND THE LIKE

FIELD OF THE INVENTION

The present invention relates to an advertising display means for a sign post or the like, and more particularly, to a miniature "billboard" for a municipal, public or private parking meter.

BACKGROUND OF THE INVENTION

In the prior art, of which we are aware, various advertising signs, billboards or displays have been patented for use with parking meters, sign posts and the like. These displays invariably consist of an attachment for an existing meter installation. In one example, the attachment consists of a two-part hinged structure, one part being secured to the meter housing, and the other part being hinged on the one part and pivoted away to provide access to the advertising display. Like other examples, the attachment is rigidly secured to the meter housing (or other structure of the meter) by suitable internally-accessible fastening means. In another example, the attachment includes elongated straps that depend therefrom and terminate in a semi-circular collar that cooperates with a suitable clamp for rigidly securing the attachment to the column or post of the parking meter. Moreover, in most cases, the advertising display is housed in a laminated structure including transparent partitions through which the display may be viewed.

These prior art disclosures suffer from a number of inherent deficiencies and disadvantages, the most serious of which are as follows: The attachments invariably consist of an appendage to an existing meter and its installation may require some modification of the meter structure. This is inconvenient and time consuming, and besides, may detract from the future utility of the meter. The attachments are usually bulky and somewhat unwieldly. Not only does this detract from the aesthetic design qualities of the meter, but a person's clothes may catch on any clamping collars, hasps, protuberances and the like. A complicated attachment, designed to be securely mounted on the meter, may actually invite vandalism or theft of the entire attachment. Moreover, the means for changing the advertising display is often complicated, which again is time consuming, and the use of specially-designed laminated windows may tend to odscure the promotional impact of the advertising message.

As a result of these inherent deficiencies and disadvantages, the prior art disclosures (to the best of our knowledge and belief) have not been widely accepted by municipalities and hence have not been commercially successful. By the same token, there still exists a critical need for a practical and readily-acceptable low-cost advertising display means for parking meters and the like. A fulfillment of this need should unleash a massive commercial potential to be shared by sponsors, advertisers, municipalities and others.

SUMMARY OF THE INVENTION

Accordingly, it is an object of the present invention to provide an advertising display means for a parking meter and the like, which substantially alleviates the inherent deficiencies and disadvantages of the prior art.

It is another object of the present invention to provide an advertising display means which is relatively simple and economical, yet may be easily and conveniently installed on existing meters either during routine maintenance in the shop or on a retrofit basis out in the field.

It is yet another object of the present invention to provide an advertising display means which includes a unitary member having an integral portion which is substantially identical to an existing, removable housing component of the meter, whereby the unitary member may be substituted for the housing component.

It is a further object of the present invention to provide a unitary member having an integral portion provided with a peripheral rim, whereby pressure-sensitive adhesive decals may be carried by the integral portion directly inwardly of the rim, thereby discouraging removal of the decal by vandalism.

It is a still further object of the present invention to provide an improved method for installing a miniature "billboard" on a municipal parking meter.

In accordance with the broad teachings of the present invention, an advertising display means is provided for use with a parking meter or the like, wherein the meter has a removable housing component disposed substantially at the top thereof. The display means comprises a unitary member having a first portion substantially identical to the housing component. As a result, the unitary member may be readily substituted for the housing component of existing meters on a retrofit basis out in the field or in the workshop during regular maintenance. The unitary member has a substantially planar second portion integral with the first portion and extending vertically above the parking meter. This second portion has a substantially flat face formed with a peripheral rim extending laterally therefrom; and a message carrier means, preferably comprising a pressure-sensitive adhesive decal, is secured to the flat face inwardly of the rim.

In accordance with the further teachings of the present invention, the integral second portion of the unitary member has a pair of parallel flat faces, and a decal is secured to each of the faces inwardly of the rim and substantially adjacent thereto. The decal has a plan outline and dimensions corresponding substantially to the plan outline and dimensions of the flat face. This arrangement allows the message to be quickly installed out in the field, yet the decal cannot be easily removed or vandalized without the use of a special implement. New decals may be easily installed over existing decals, since each decal is substantially opaque and is relatively thin in comparison to the width of the laterally-extending rim. Eventually, an accummulation of decals may be scraped off, whenever convenient.

These and other objects of the present invention will become apparent from a reading of the following specification taken in conjunction with the enclosed drawings.

DESCRIPTION OF A PREFERRED EMBODIMENT

Figure 1:
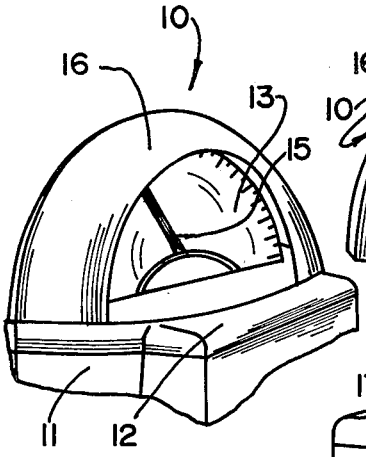
FIG. 1 is a partial perspective of the top portion of a typical municipal parking meter.
Figure 2:
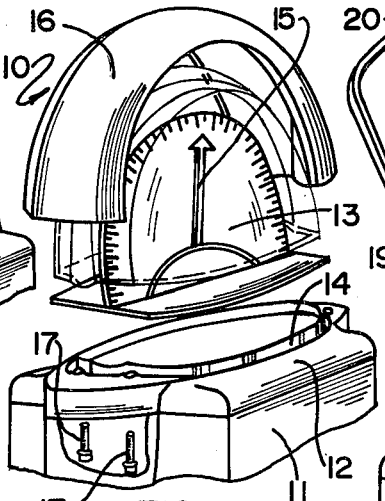
FIG. 2 is an exploded view, corresponding substantially to FIG. 1, but showing the top housing component removed from the meter.
Figure 3:
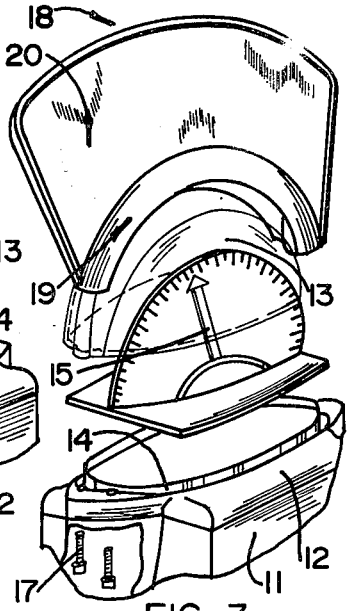
FIG. 3 is a further exploded view, corresponding substantially to FIG. 2, but showing a preferred embodiment of the unitary member of the present invention being substituted for the removable housing component of the meter.

With reference to FIGS. 1–3, there is illustrated the top portion of a typical parking meter 10 used by municipalities, private parking lots and others. It will be appreciated by those skilled in the art that the teachings of the present invention are not necessarily restricted to the particular parking meter illustrated herein, but rather, are equally applicable to a wide variety of parking meter designs and constructions. With this in mind, the parking meter 10 includes a main housing 11 (shown in fragmentary form) a housing cap 12 carried by the main housing, a transparent dome 13 nested within a continuous groove 14 formed on the housing cap, a meter dial 15 visible through the dome, and a removable housing component comprising an arcuate cap strap 16 which retains the dome in position. This cap strap 16 is secured to the housing cap by a plurality of screws 17 which are only accessible internally of the meter housing. Thus, as shown in FIG. 3, an authorized agent may easily remove the cap strap out in the field (or during routine maintenance in the workshop) and replace it with the unitary member 18 of the present invention.

Figure 4:
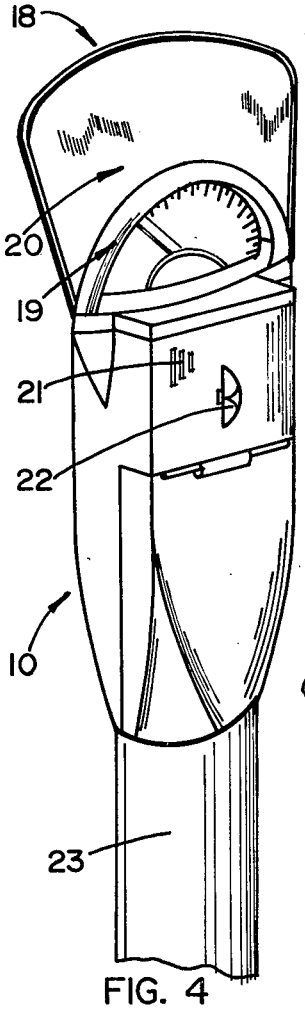
FIG. 4 is a perspective of the complete parking meter with the unitary member of the present invention installed thereon.
Figure 5:
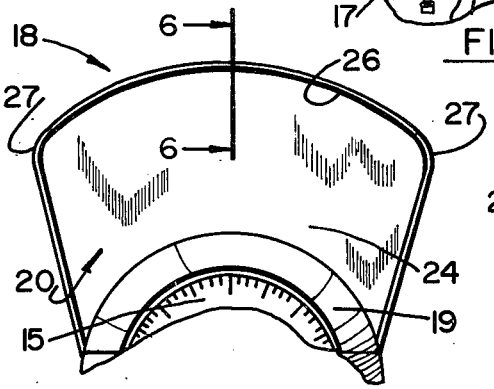
FIG. 5 is a front elevation, drawn to an enlarged scale, of the unitary member installed on the parking meter.
Figure 6:
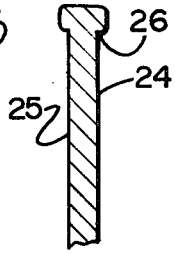
FIG. 6 is a section thereof, taken along the lines 6—6 of FIG. 5.
Figure 7:
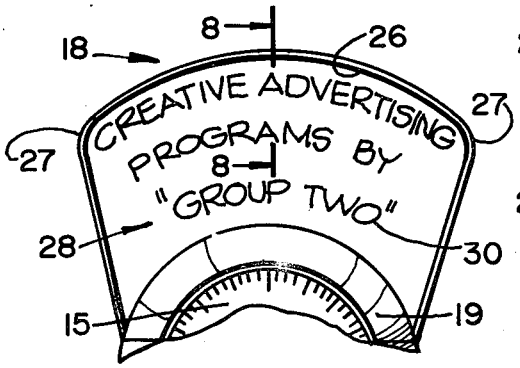
FIG. 7 is a further front elevation of the unitary member, corresponding to FIG. 5, but showing the pressure-sensitive adhesive decal secured thereon.

This unitary member 18 thus comprises a replacement meter housing. It has a first portion 19, which is substantially identical to the removable cap strap 16, and hence is adapted to the particular configuration of the meter 10. The unitary member further has a second portion 20, integral with the first portion, and extending therefrom vertically above the meter. As shown in FIG. 4, the meter itself is conventional and includes the usual coin slots 21, turnable knob 22 and post 23. The unitary member could be fabricated if desired; however, preferably it is integrally cast from a suitable metal, such as steel. If desired, the unitary member could be cast from other suitable materials, such as a high-impact plastic, glass-fiber, or rubber composition. Since the unitary member is rigidly mounted to the meter and becomes an integral part thereof, it is capable of withstanding most forms of vandalism. Moreover, its smooth integrated appearance (in relation to the overall meter) will tend to discourage vandalism in the first instance.

With reference to FIGS. 5–8, the second integral portion 20 of the unitary member is substantially planar and has a pair of parallel flat faces 24, 25 and a peripheral rim 26 extending laterally (and preferably, at right angles) therefrom. Preferably, but not necessarily, each of the faces of the integral planar portion has a plan outline generally in the form of an arcuate section of a radial segment of a circle. Moreover, the planar portion does not extend substantially beyond the width of the parking meter, and its corners are rounded off (as at 27) to avoid snagging the motorist's clothes.

Figure 9:
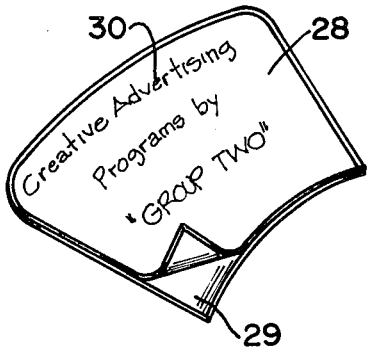
FIG. 9 is a perspective of a flat pressure-sensitive decal, showing the protective waxed paper being removed therefrom to expose the adhesive backing.

A message carrier means is provided for use with the unitary member of the present invention. Preferably, this message carrier means comprises a pressure-sensitive adhesive decal 28. As shown in FIG. 9, this decal has a protective waxed paper backing 29 that may be easily peeled off for easy mounting of the advertisement.

However, the scope of the present invention is not confined to the particular decal 28, and it will be appreciated by those skilled in the art that any type of suitable pressure-sensitive label or sticker may be employed; or, if desired, a separate card or metal plate may be glued on (or secured on) out in the field. Also, the message could be integrally molded or embossed on the integral portion of the planar member.

Figure 8:
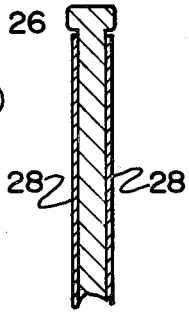
FIG. 8 is a section therof, taken along the lines 8—8 of FIG. 7.
Figure 10:
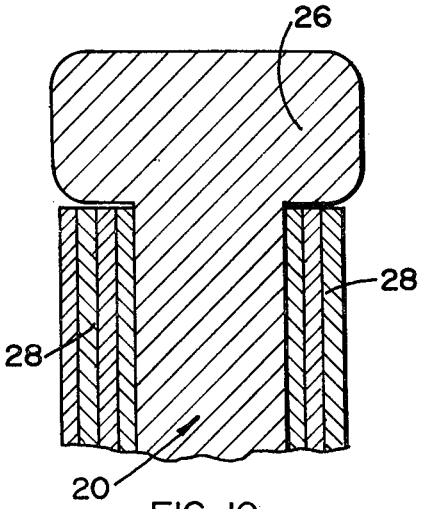
FIG. 10 is a portion of FIG. 8, drawn to an enlarged scale, and showing how a plurality of opaque decals may be easily installed (one on top of another) on the unitary member of the present invention.

Of more significance, the plan outline and dimensions of the decal substantially approximate the plan outline and dimensions of the flat faces 24, 25. As a result, the decal is mounted to one of the flat faces directly inwardly of the rim and closely adjacent thereto (as shown in FIG. 8). Thus it will be difficult for a vandal to lift off the decal merely by using a thumb nail or finger nail. This makes vandalism much more difficult or else discourages it altogether. The decal carries a suitable advertising message (indicated generally at 30). An identical decal may be placed on the opposite face of the planar portion, if desired, as shown in FIG. 8. Moreover, since the decals are relatively thin in relation to the lateral width of the rim, a plurality of decals may be carried by each face (as shown in FIG. 10). The decals are sufficiently opaque so that the prior decal and its message are totally obscured. Each decal may be specially coated with a plastic film to withstand the extremes of weather and temperature, so that the advertising message will be clear and continually "fresh" for its intended duration. Eventually, the accumulation of decals may be scraped off, whenever convenient, using a scraper or other suitable implement.

Figure 11:
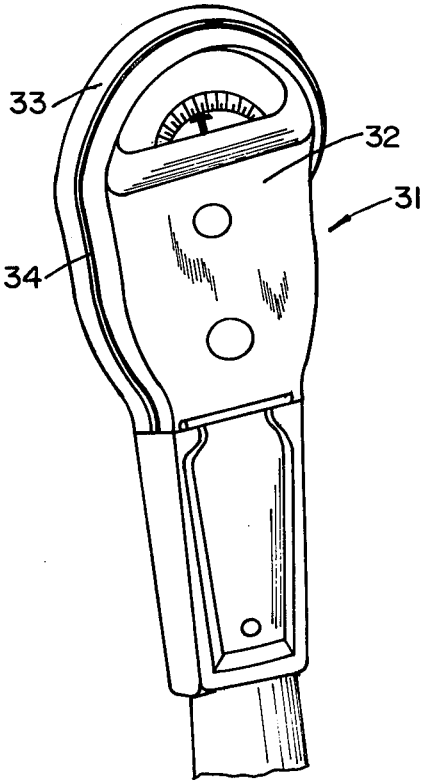
FIG. 11 is a partial perspective of another conventional parking meter to which the teachings of the present invention may be applied.
Figure 12:
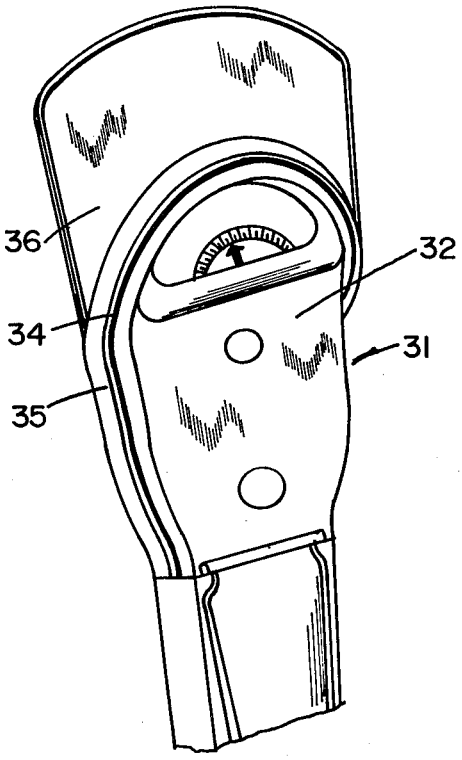
FIG. 12 is a further partial perspective, corresponding substantially to FIG. 11, but showing a modified embodiment of the unitary member of present inventions installed thereon.

The meter 10 (illustrated herein by way of example) is the Duncan Model "60" Parking Meter, which is widely used by municipalities. However, as previously noted, the scope of the present invention is not to be limited thereto. Another example is the meter 31 illustrated in FIGS. 11 and 12. This meter 31, which is manufactured by P.O.M. Incorporated of Russellville, Arkansas, has a two-part housing including housing members 32 and 33. Housing member 33 has a peripheral flange 34 and serves as a cover for housing member 32. As shown in FIG. 12, housing member 33 has been removed and replaced by a unitary member comprising a new housing member 35. This new housing member 35 is substantially identical to member 33, but is provided with an integral planar portion 36. This planar portion 36 is substantially identical to the planar portion 20 of the preferred embodiment of FIG. 4.

Thus it will be appreciated that an advertising display means or miniature "billboard" has been provided for municipal parking meters and the like, one which alleviates the inherent deficiencies and disadvantages of the prior art. Indeed, by providing the integrally-cast unitary member of the present invention, the following advantages are realized: The device is simple and economical to produce, and expensive tooling charges are avoided. It is easy to install on a retrofit basis out in the field. It has a smooth integrated appearance, is not obtrusive, and discourages theft or vandalism. Moreover, the advertising message will remain clearly visable for a desired duration.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. In combination with a pole-mounted type of parking meter having a removable housing disposed substantially at the top of the meter and adapted to cover at least a portion thereof, an attachment comprising a unitary member having a first portion substantially identical to the housing, whereby the unitary member may be readily substituted for the housing of the meter, said unitary member having a second portion integral with the first portion and extending vertically therefrom above the parking meter, said second portion having a face formed with a peripheral rim extending laterally therefrom, and an advertisement having a plan outline corresponding substantially to the face and secured thereto inwardly of the rim.

2. In combination with a pole-mounted type of parking meter having a removable housing disposed substantially at the top of the meter and adapted to cover at least a portion thereof, an attachment comprising a unitary member having a first portion substantially identical to the housing, whereby the unitary member may be readily substituted for the housing of the meter, said unitary member having a second portion integral with the first portion and extending vertically therefrom above the parking meter, said second portion having a pair of parallel flat faces, and an advertisement secured to each of the faces.

3. In combination with a pole-mounted type of parking meter having a removable housing disposed substantially at the top of the meter and adapted to cover at least a portion thereof, an attachment comprising a unitary member having a first portion substantially identical to the housing, whereby the unitary member may be readily substituted for the housing of the meter, said unitary member further having a substantially planar second portion integral with the first portion and extending vertically therefrom above the parking meter, said second portion having a pair of parallel flat faces and further having a peripheral rim extending laterally from each of the faces, and at least one message carrier means having a plan outline and dimensions closely approximating the plan outline and dimensions of a respective flat face, said message carrier means being secured to said flat face inwardly of the rim thereof.

4. The combination of claim 3, wherein a respective message carrier means is carried by each of the flat faces.

5. The combination of claim 4, wherein the message carrier means comprises respective pressure-sensitive adhesive decals each bearing an advertisement.

6. The combination of claim 5, wherein the decals are sufficiently opaque, whereby a new decal may be placed over an old decal, repeatedly, and wherein an accumulation of decals may be scraped off eventually.

7. The combination of claim 3, wherein the faces of the integral planar portion have a plan outline generally in the form of an arcuate section of a radial segment of a circle.

8. The combination of claim 3, wherein the removable housing component comprises an arcuate cap strap.

9. The combination of claim 3, wherein the unitary member is integrally cast.

10. In combination with a parking meter having a removable housing, an attachment comprising an integrally-cast rigid unitary member having a first portion substantially identical to the housing, whereby the unitary member may be readily substituted for the housing of the meter, said unitary member having a second portion integral with the first portion and having a peripheral rim formed thereon, and a pressure-sensitive adhesive decal bearing an advertising message and secured to the integral second portion inwardly adjacent of the rim thereon, whereby the decal may not be easily removed.

11. The method of installing a miniature "billboard" bearing an advertising message on a municipal parking meter, wherein the meter is provided with an internally-accessible removable housing adapted to cover at least a portion of the meter, comprising the steps of providing an attachment comprising a unitary member having at least a portion thereof which is substantially identical to the removable housing, removing the housing from the meter and substituting the unitary member therefor, the unitary member further having an integral portion intended to be viewed by motorists or pedestrians, providing an adhesive pressure-sensitive decal with a protective backing, the decal carrying the advertising message, peeling off the backing from the decal, and affixing the decal to the integral portion of the unitary member.

12. The method of claim 11, further including the steps of providing additional decals, each of which is opaque, and affixing the additional decals, sequentially and as desired, over the original decal.

13. The method of claim 12, further including the step of forming the integral portion of the unitary member with means to discourage removal of the decals by a vandal.

14. In a parking meter having an advertising display, the improvement which comprises an attachment having a first portion and a second portion cast integrally therewith, said first portion being substantially identical to a removable housing cover for the meter, whereby the meter housing cover may be removed conveniently, and whereby said attachment may be readily substituted therefor on a retrofit basis without permanently altering the structure of the meter, and an advertisement carried by said second portion of said attachment.

15. In a parking meter having an advertising display, wherein the parking meter has a removable housing cover, and wherein internally-accessible fastening means secures the housing cover to the meter, the improvement which comprises an attachment having at least a first portion which is substantially identical to the removable housing cover, whereby the housing cover may be removed conveniently and replaced by said attachment using the same said fastening means, and whereby said attachment may be substituted for the meter housing cover on a retrofit basis without altering the meter structure, said attachment further having a second portion, and an advertisement carried by said second portion of said attachment.

* * * * *